US007214073B2

(12) United States Patent
Asai

(10) Patent No.: US 7,214,073 B2
(45) Date of Patent: May 8, 2007

(54) SHIELDING STRUCTURE

(75) Inventor: Kiyoshi Asai, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/988,317

(22) Filed: Nov. 12, 2004

(65) Prior Publication Data

US 2005/0282412 A1 Dec. 22, 2005

(30) Foreign Application Priority Data

Jun. 22, 2004 (JP) ..... 2004-183487

(51) Int. Cl.
*H01R 12/00* (2006.01)

(52) U.S. Cl. ..... 439/74

(58) Field of Classification Search ..... 439/74, 439/70, 108, 78, 660, 607
See application file for complete search history.

(56) References Cited

U.S. PATENT DOCUMENTS 5,836,773 A * 11/1998 McHugh et al. ..... 439/74
5,842,874 A * 12/1998 Yagi et al. ..... 439/74
5,915,975 A * 6/1999 McGrath ..... 439/74
5,921,814 A * 7/1999 Maruyama ..... 439/607
6,077,121 A * 6/2000 Wu ..... 439/607

FOREIGN PATENT DOCUMENTS

JP 06-338435 12/1994

OTHER PUBLICATIONS

Patent Abstracts of Japan for JP06-338435 published on Dec. 6, 1994.

* cited by examiner

*Primary Examiner*—Alexander Gilman
(74) *Attorney, Agent, or Firm*—Darby & Darby

(57) ABSTRACT

The present invention include a main substrate on which electronic components are mounted; a secondary substrate wherein electronic components are mounted on a surface facing a mounting surface of the main substrate; and a shield perimeter wall formed by arranging multiple shielded substrate connectors connecting the main substrate and the secondary substrate so that an electronic circuit is surrounded. The shielded substrate connectors is formed from plugs mounted on either main or secondary substrate and sockets mounted on the other substrate, the plugs and the sockets being removably connected. The plugs and the sockets are attached to the main substrate and the secondary substrate with an attachment tool member that supports the plugs or sockets so that they are aligned with the shield perimeter wall.

9 Claims, 14 Drawing Sheets

SHIELDING STRUCTURE

INCORPORATION BY REFERENCE

The present application claims priority under 35 U.S.C. §119 to Japanese Patent Application No. 2004-183487 filed on Jun. 22, 2004. The content of the application is incorporated herein by reference in its entirety.

BACKGROUND OF THE INVENTION

The present invention relates to a shield structure primarily for shielding high-frequency circuits and the like formed from multiple electronic components.

Conventionally, shielding electronic circuits such as high-frequency circuits formed from multiple electronic components attached to a substrate has been done by covering and surrounding the high-frequency circuit with a shield case formed as a box-shaped structure of conductive material. See, for example, Japanese Laid-Open Patent Publication Number Hei 06-338435.

However, in conventional technologies such as the one described above, the shield case must become larger if the number of electronic parts in the high-frequency circuit or the like increases, increasing the amount of space taken up on the substrate by these electronic parts. This makes it difficult to provide compact designs for devices.

OBJECT AND SUMMARY OF THE INVENTION

The object of the present invention is to overcome the problems of the conventional technology described above and to provide a shield structure that allows compact designs.

In order to overcome the problems described above, the present invention includes: a main substrate on which are mounted electronic components forming an electronic circuit. A secondary substrate is separated by a space from the main substrate and electronic components forming the electronic circuit are mounted on a surface of the secondary substrate that faces a mounting surface of the main substrate. Also, a shield perimeter wall is formed by a plurality of shielded substrate connectors connecting the main substrate and the secondary substrate. The plurality of shielded substrate connectors are disposed so as to surround the electronic circuit. The shielded substrate connector is formed from a plug mounted on either the primary or secondary substrate and a socket mounted on the other substrate and detachably connected to the plug. The plugs and the sockets are attached to the main substrate and the secondary substrate while being supported by an attachment tool member for supporting the plug or the socket in alignment with the shield perimeter wall.

In addition to the structure above, in the invention described an embodiment where the shielded substrate connector further includes a shield connection piece, formed from a conductive material, that connects shields of the shielded substrate connectors that are adjacent to each other along the perimeter.

In addition to the structures above, an embodiment of the plug include a synthetic resin plug housing and a plurality of plug contacts including plug elastic contact pieces exposed on a side surface of the plug housing. A plug shield member is formed from a conductive metal member that covers a side surface opposite from the side surface from which the plug elastic contact pieces are exposed.

The socket includes a socket housing formed with a plug insertion hole into which the plug is inserted a plurality of socket contacts including a socket elastic contact piece projecting into the plug insertion hole, and a socket shield member formed from a conductive metal member covering a side surface of the socket housing.

When the plug is inserted into the plug insertion hole, the plug elastic contact piece and the socket elastic contact piece form an elastic contact, and a contact is formed between the plug shield member and the socket shield member.

In addition to the structure above, the plug contact and the socket contact can include an attachment piece supported by the housing and a terminal continuous with one end of the attachment piece and pointing inward from the shield perimeter wall. The terminal is connected integrally with a carrier plate and a plurality of contacts are attached to the housing with the plurality of contacts supported integrally by the carrier plate, separated by spaces.

The shield structure a main substrate on which are mounted electronic components forming an electronic circuit, a secondary substrate separated by a space from the main substrate, electronic components forming the electronic circuit being mounted on a surface of the secondary substrate that face a mounting surface of the main substrate, and a shield perimeter wall formed by a plurality of shielded substrate connectors connecting the main substrate and the secondary substrate. The plurality of shielded substrate connectors can be disposed so as to surround the electronic circuit. Since the electronic parts forming the electronic circuit can be mounted on both the main and secondary substrates, the space taken up on the substrates by the electronic parts is reduced, thus allowing a compact design.

Also, the process for mounting the electronic components forming the electronic circuit can be divided into a step for the main substrate and the secondary substrate. This reduces the time required and can reduce production costs.

The shielded substrate connector can be formed from a plug mounted on either the primary or secondary substrate and a socket mounted on the other substrate and detachably connected to the plug. The plugs and the sockets can be attached to the main substrate and the secondary substrate while being supported by an attachment tool member for supporting the plug or the socket in alignment with the shield perimeter wall. As a result, the sockets and plugs can be mounted with a high degree of attachment precision, thus providing good connections.

The shielded substrate connector can further include a shield connection piece, formed from a conductive material, that connects shields of the shielded substrate connectors that are adjacent to each other along the perimeter. As a result, superior shielding can be provided.

The plug can include a synthetic resin plug housing, a plurality of plug contacts including plug elastic contact pieces exposed on a side surface of the plug housing, and a plug shield member formed from a conductive metal member that covers a side surface opposite from the side surface from which the plug elastic contact pieces are exposed. The socket can include a socket housing formed with a plug insertion hole into which the plug is inserted, a plurality of socket contacts including a socket elastic contact piece projecting into the plug insertion hole, and a socket shield member formed from a conductive metal member covering a side surface of the socket housing. When the plug is inserted into the plug insertion hole, the plug elastic contact piece and the socket elastic contact piece form an elastic contact, and a contact is formed between the plug shield member and the socket shield member.

The plug contact and the socket contact can include an attachment piece supported by the housing and a terminal continuous with one end of the attachment piece and pointing inward from the shield perimeter wall. The terminal is connected integrally with a carrier plate and a plurality of contacts are attached to the housing with the plurality of contacts supported integrally by the carrier plate, separated by spaces. Thus, the contacts can be efficiently attached to the housing and costs can be reduced.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 10(*b*) is a front-view drawing of FIG. 10(*a*);

FIG. 10(*c*) is a side-view drawing of FIG. 10(*a*);

FIG. 11(*b*) is a cross-section drawing of the plug attachment tool member of FIG. 11(*a*);

FIG. 20(*b*) is a front-view drawing of FIG. 20(*a*);

FIG. 20(*c*) is a side-view drawing of FIG. 20(*a*);

FIG. 21(*b*) is a cross-section drawing of FIG. 21(*a*);

DETAILED DESCRIPTION OF THE PREFERRED EMBODIMENTS

Figure 1:
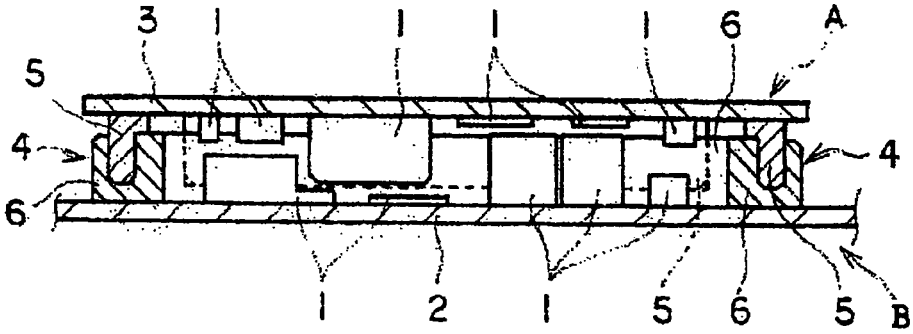
FIG. 1 is a cross-section drawing showing a shield structure according to the present invention.
Figure 2:
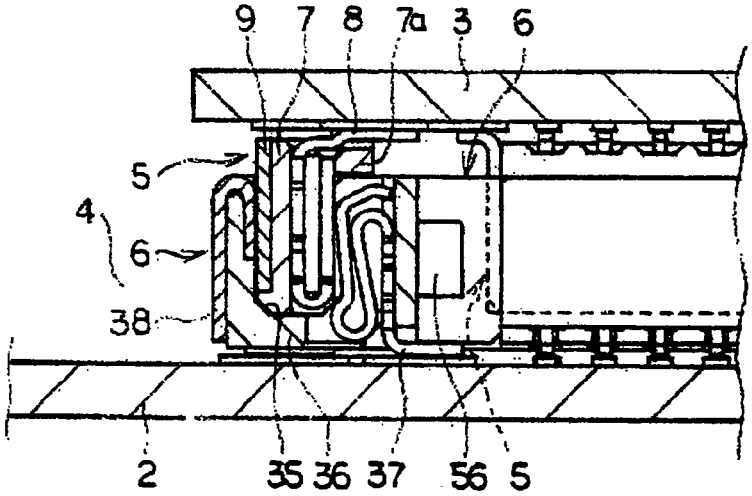
FIG. 2 is a magnified cross-section detail drawing of the shield structure of FIG. 1.
Figure 3:
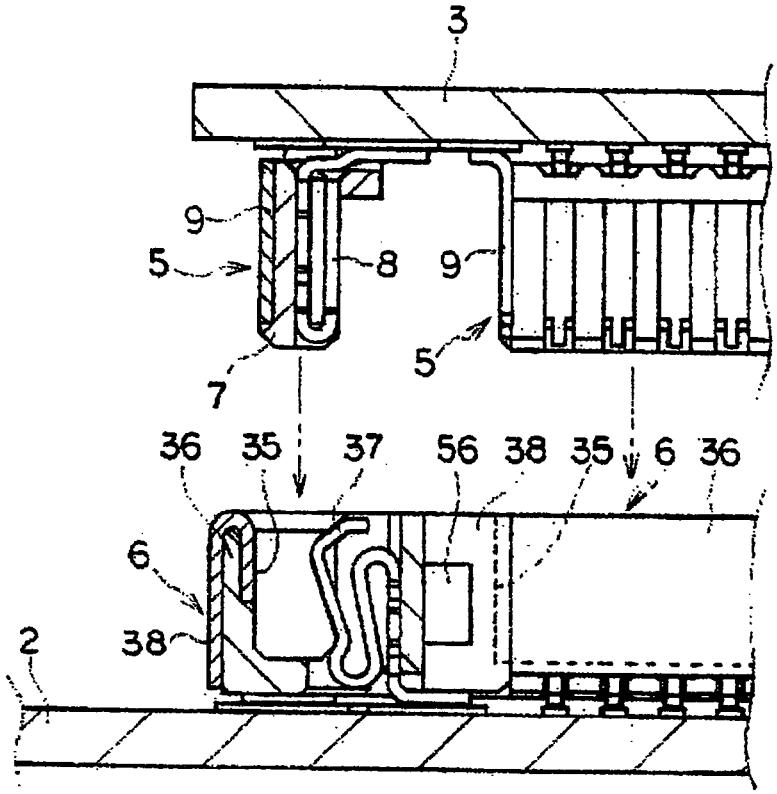
FIG. 3 is an example cross-sectional view showing the shielded substrate connector in a separated state of the present invention.
Figure 4:
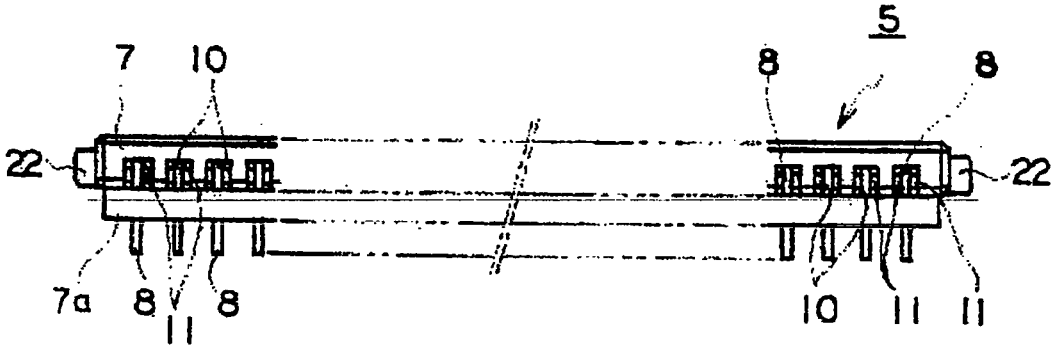
FIG. 4 is a plan drawing of a plug of the present invention.
Figure 5:
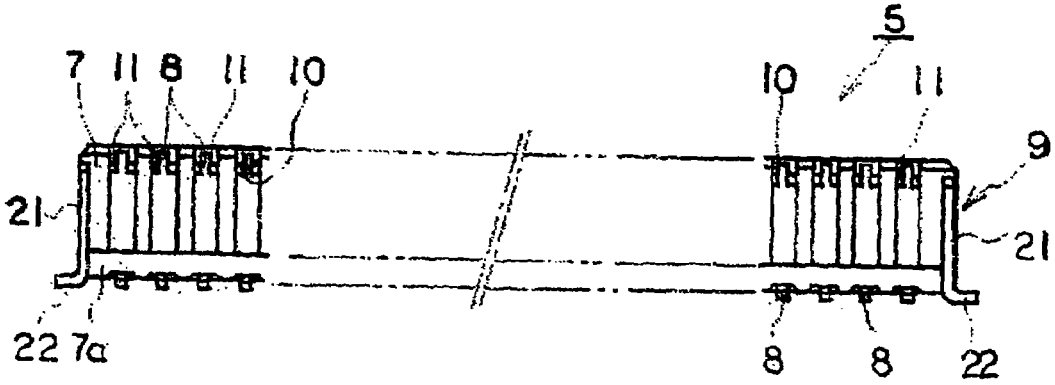
FIG. 5 is a front-view drawing of the plug of FIG. 4.
Figure 6:
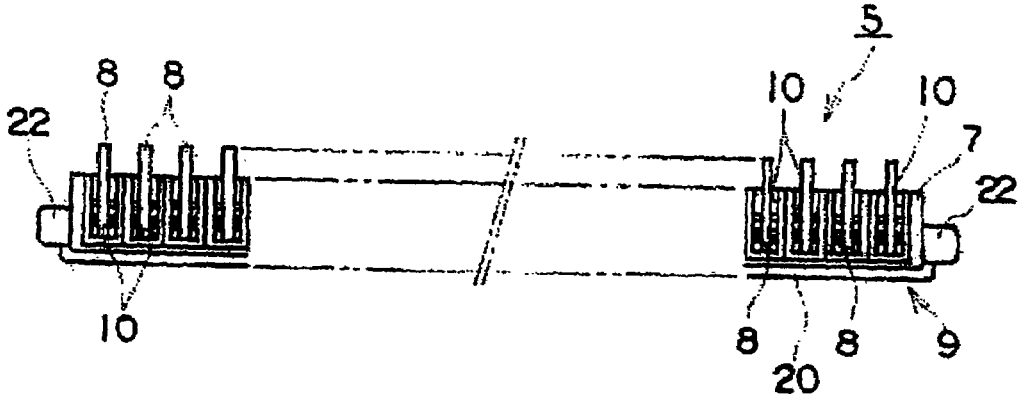
FIG. 6 is a bottom-view drawing of the plug of FIG. 4.
Figure 7:
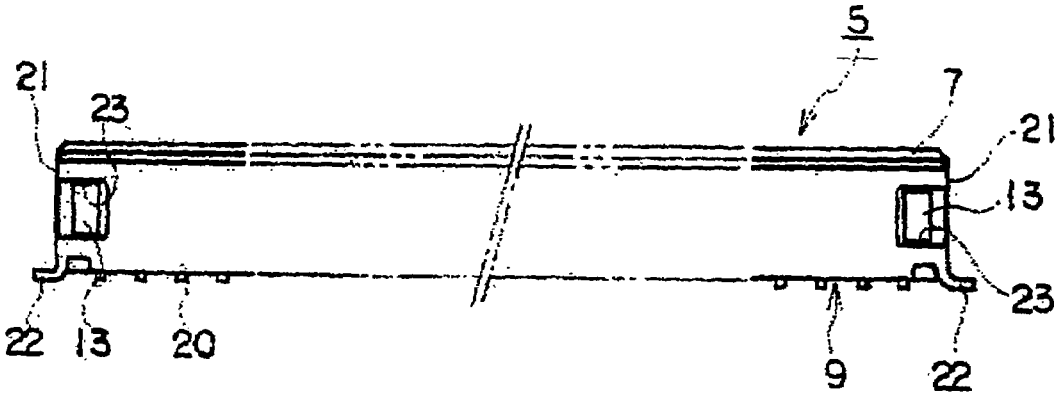
FIG. 7 is a rear-view drawing of the plug of FIG. 4.
Figure 8:
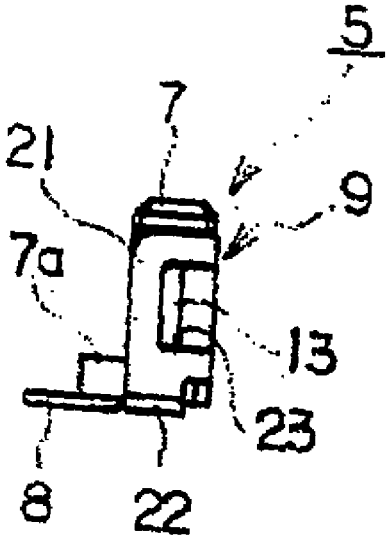
FIG. 8 is a side-view drawing of the plug of FIG. 4.
Figure 9:
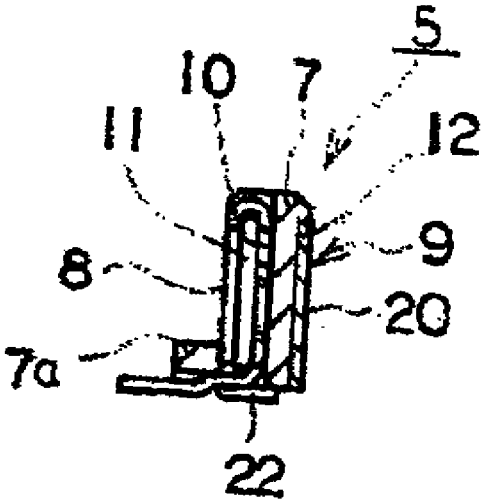
FIG. 9 is a cross-section drawing of the plug of FIG. 4.

A shield structure according to the present invention is shown in FIG. 1 through FIG. 3 and include a main substrate 2 on which electronic components 1 are mounted. A secondary substrate 3 can also accept electronic components 1 on the surface thereof facing a mounting surface of the main substrate 2. A shield perimeter wall can include multiple shielded substrate connectors 4 connecting the main substrate 2 and the secondary substrate 3 are disposed to surround the electronic components 1. The electronic circuit, e.g., a high-frequency circuit is formed by the electronic components 1 and mounted on the main substrate 1. Further the secondary substrate 3 can be surrounded by the main substrate 2. The secondary substrate 3 and the shield perimeter wall, i.e., the multiple shielded substrate connectors 4 can provide shielding for the electronic circuit.

The shielded substrate connector 4 is formed from a plug 5 mounted on the primary substrate 2 or the secondary substrate 3 and a socket 6 that can be attached to or removed from the plug 5.

As shown in FIG. 4 through FIG. 9, the plug 5 include a plug housing 7 multiple plug contacts 8 that can be supported by the plug housing 7 and a plug shield member 9 fitted to the outer perimeter surface of the plug housing 7.

The plug housing 7 is formed in a rectangular shape with an insulative material such as synthetic resin and is formed integrally with a projection 7*a* disposed at the inside of the bottom end.

In this plug housing 7, multiple contact attachment holes 10 can be formed parallel to each other at predetermined intervals. The attachment holes 10 pass through the housing 7 from top to bottom and are open at one side surface. More specifically, the attachment holes 10, 10 . . . open on the inner perimeter side of the shield perimeter wall. Pairs of securing ribs 11, 11 are formed integrally on the inner perimeter surfaces of the contact attachment holes 10, 10.

A support cavity 12 into which the plug shield member 9 is fitted is formed on the outer perimeter side of the shield perimeter wall of the plug housing 7. Engagement projections 13 are formed integrally on either side of the support cavity 12 to secure the plug shield member 9.

Figure 10A:
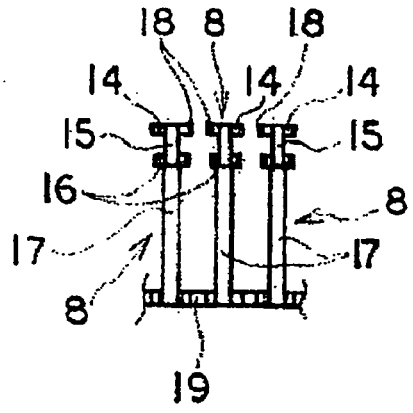
FIG. 10(*a*) is a plan drawing of a plug contact supported by a carrier plate of the present invention.
Figure 10B:
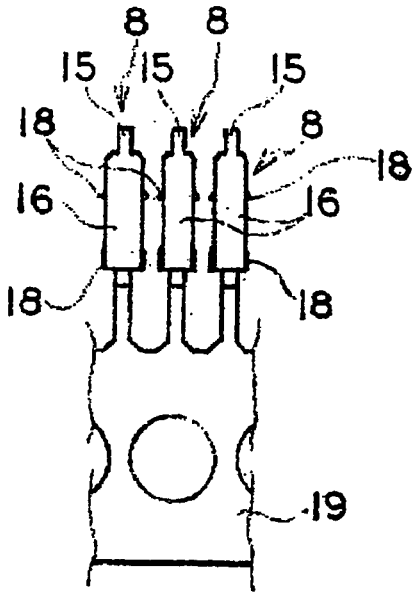
Figure 10C:
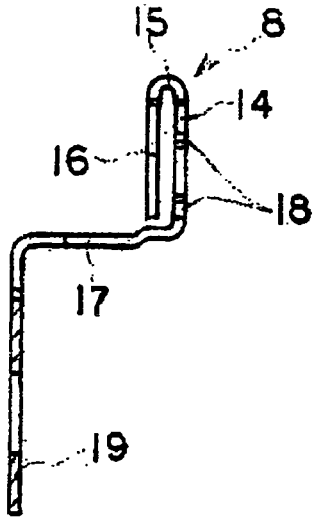

As shown in FIG. 10, the plug contact 8 is inserted into the contact attachment hole 10 of the plug housing 7. The plug contact 8 include an attachment piece 14 supported by the plug housing 7 a bend 15 formed as a "U"-shape from one end of the attachment piece 14 an elastic contact piece 16 continuous with the other end of the bend 15 and a terminal piece 17 bent from the other end of the attachment piece 14. The plug contact 8 is formed by punching a conductive plate material such as a copper member into a predetermined shape and bending it.

The attachment piece 14 is formed as a thin plate having a width roughly the same as the width of the contact attachment hole 10, and engagement projections 18 are formed integrally on the side edges.

The bend 15, formed continuously with one end of the attachment piece 14, has a width narrower than that of the attachment piece 14 and slightly narrower than the gap formed between the securing ribs 11 of the contact attachment hole 10.

The elastic contact piece 16 can be formed as a thin plate continuous with the end of the bend 15 opposite from the attachment piece 14 with a width that is wider than that of the bend 15.

The terminal 17 is continuous with the end of the attachment piece 14 opposite from the bend 15 and is bent to be roughly perpendicular to the attachment piece 14, i.e., to point toward the inside of the shield perimeter wall when attached to the plug housing 7.

The end of the terminal 17 opposite from the attachment piece 14 is integrally connected to a carrier plate 19, and the multiple plug contacts 8 are supported parallel to each other on the carrier plate 19 at a predetermined pitch, i.e., the pitch at which the plug contacts 8 are attached to the plug housing 7.

Terminal 17 and the carrier plate 19 can be formed with notches at the side edge of the connecting point so that once the plug contacts 8 are attached to the plug housing 7, the terminal 17 and the carrier plate 19 can be easily separated.

The plug shield member 9 is formed integrally from a plate-shaped shield plate 20, integrally formed side plates 21, 21 at the side edges of the shield plate 20, and a securing piece 22 projecting outward from the bottom edge of the side plate 21. The plug shield member 9 can be formed integrally by bending a conductive metal plate.

Engagement holes 23, 23 are formed at the side sections of the shield plate 20 to allow engagement of the engagement projection 13 formed at the outer perimeter surface of the plug housing 7. The engagement of the engagement projection 13 with the engagement hole 23 secures the plug shield member 9 to the plug housing 7.

The plugs 5 are mounted on the secondary substrate 3 using a plug attachment tool member 24 so that the electronic components 1 mounted on the secondary substrate 3 are surrounded.

Figure 11A:
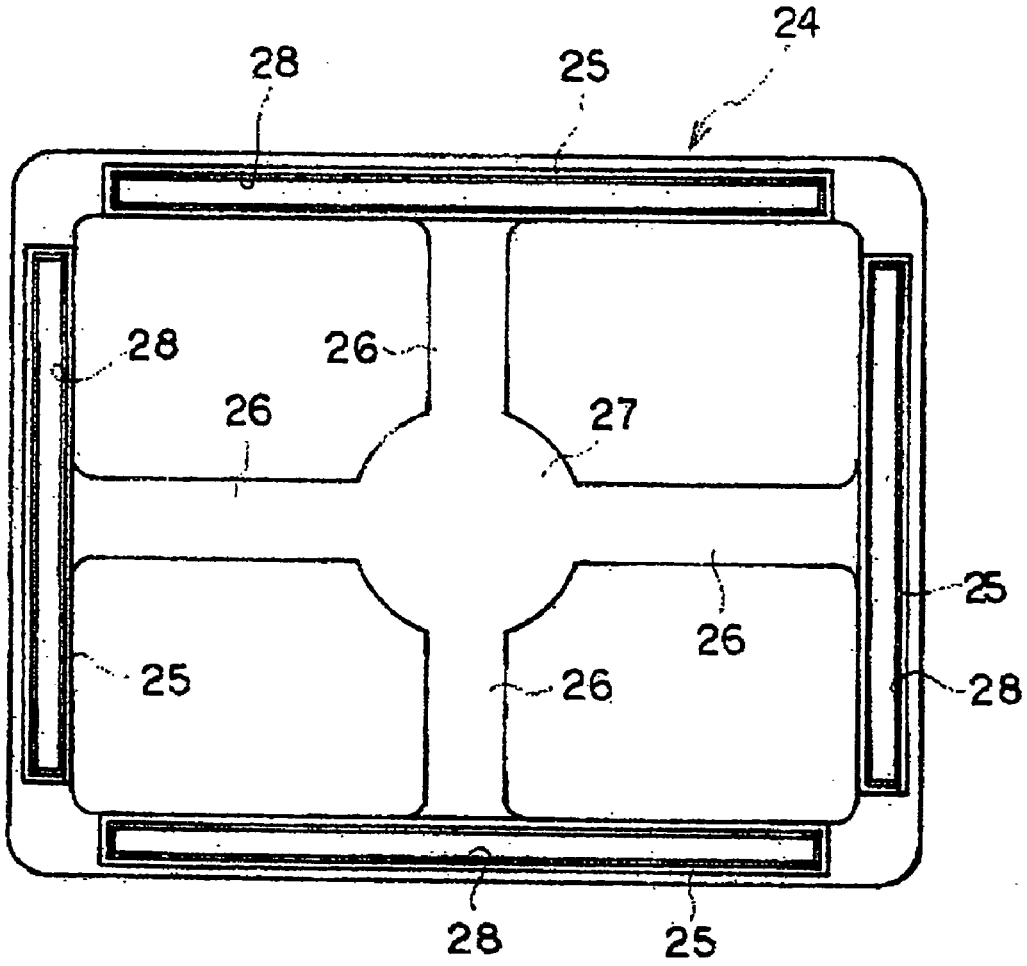
FIG. 11(*a*) is a plan drawing showing a plug attachment tool member of the present invention.
Figure 11B:
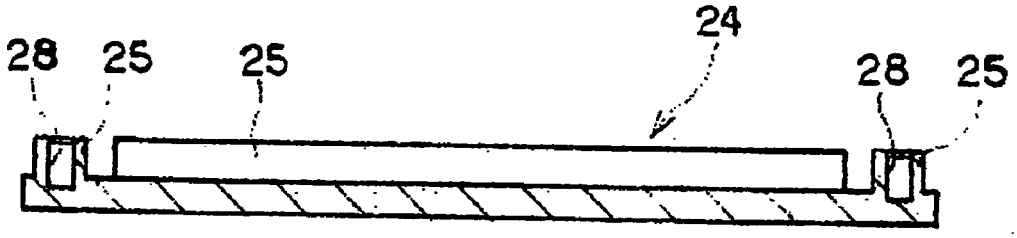

As shown in FIG. 11, the plug attachment tool member 24 is formed as a frame equipped with supports 25 projected from the four edges on one surface. At the center of the frame is formed a circular suction section 27 supported from four sides via supports 26, and this suction section 27 is suctioned by a transport device of a production device so that the tool member can be transported.

The supports 25 are formed with support holes 28 disposed according to the shape of the shield perimeter wall and into which the opposing ends of the plug 5 are inserted and fitted. In other words, in the plug attachment tool member 24, the plugs 5 are supported by the supports 25 along the shape of the shield perimeter wall.

To mount the plugs 5 onto the secondary substrate 3 using the plug attachment tool member 24, first the plugs 5 are supported on the plug attachment tool member 24, and in this state, the suction section 27 is suctioned by the transport device of the production machine so that it is transported to a predetermined position over the substrate 3, i.e., the plugs 5 are transported to a position where they will surround the electronic components 1 mounted on the substrate 3.

Figure 12:
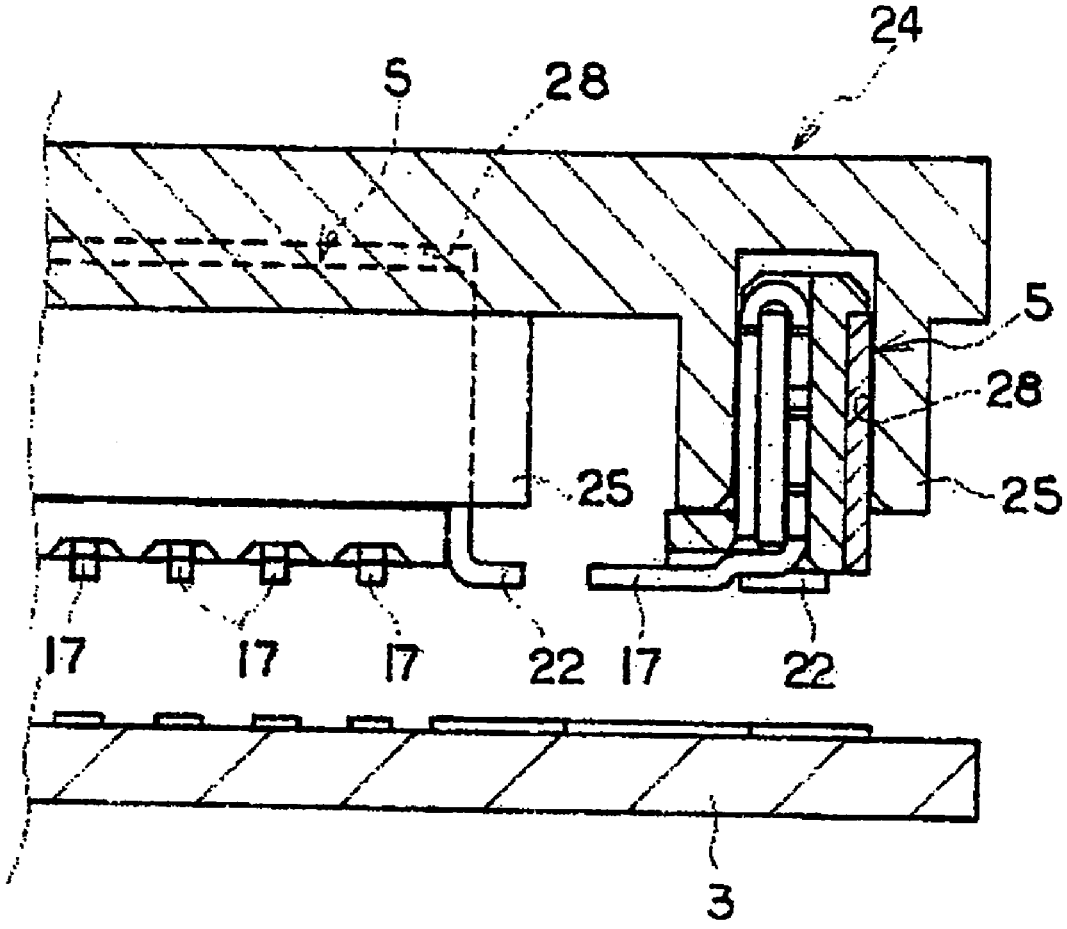
FIG. 12 is a cross-section detail drawing showing a plug attachment step.
Figure 13:
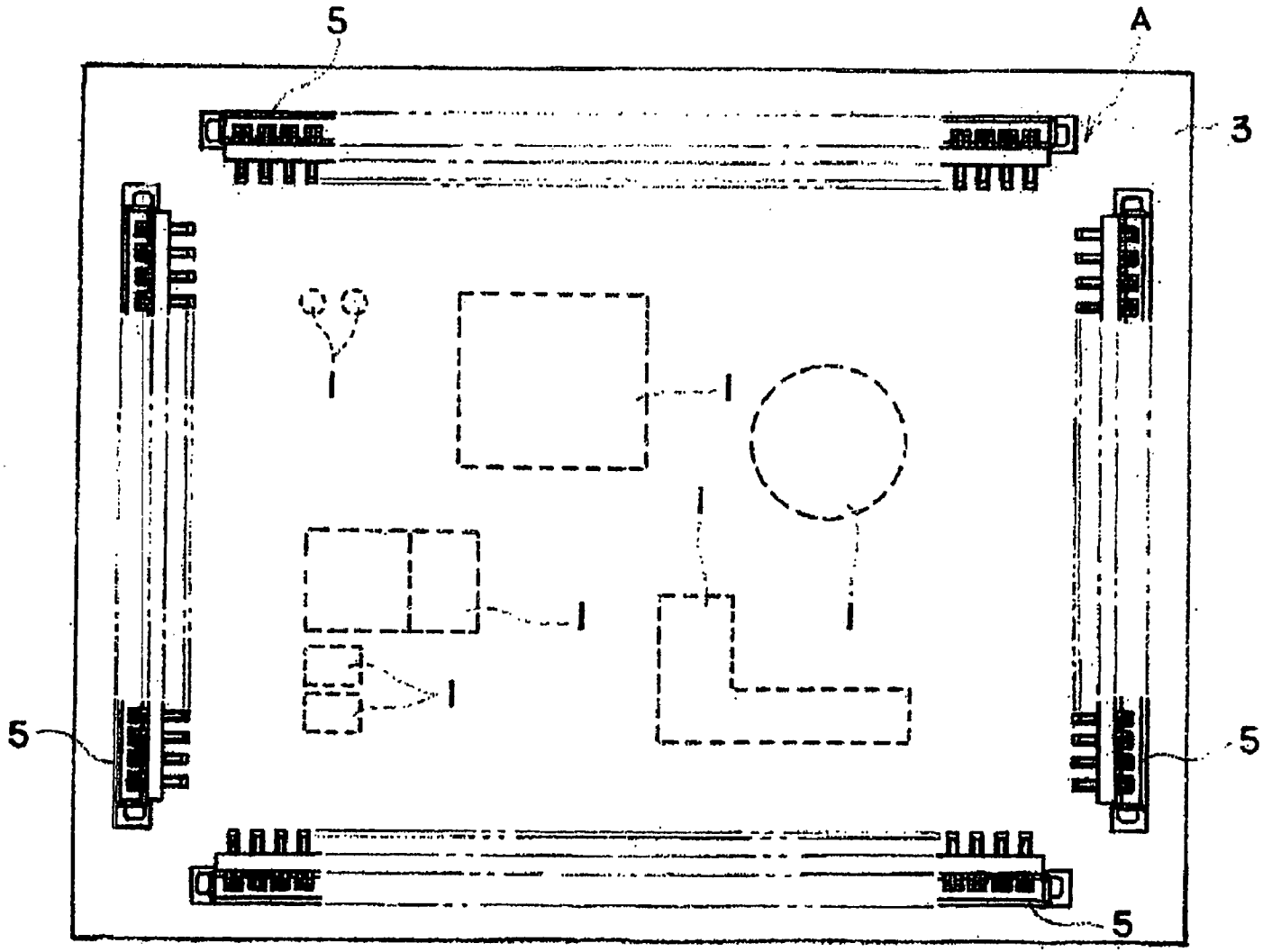
FIG. 13 is a plan drawing showing a secondary substrate assembly of the present invention.
Figure 14:
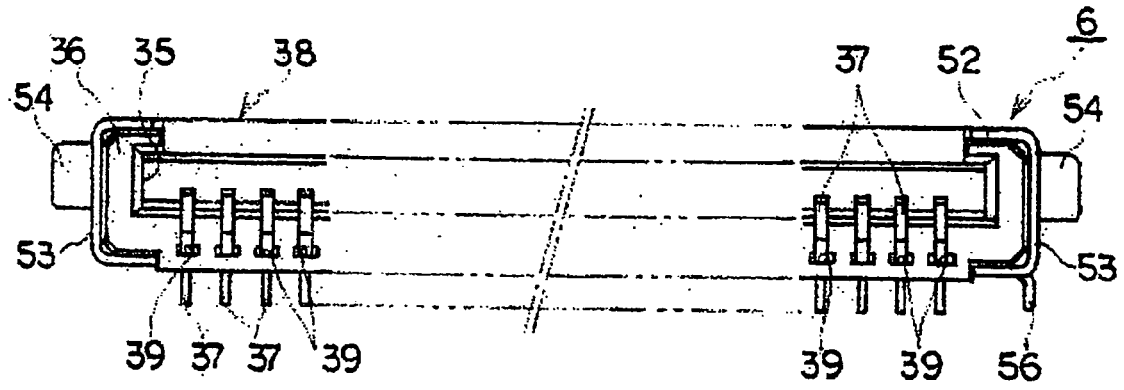
FIG. 14 is a plan drawing showing the socket of FIG. 1.
Figure 15:
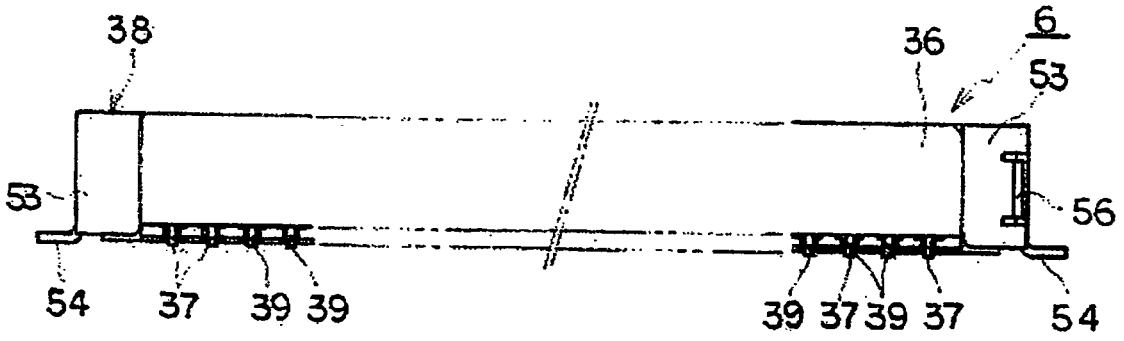
FIG. 15 is a front-view drawing of the socket of FIG. 1.
Figure 16:
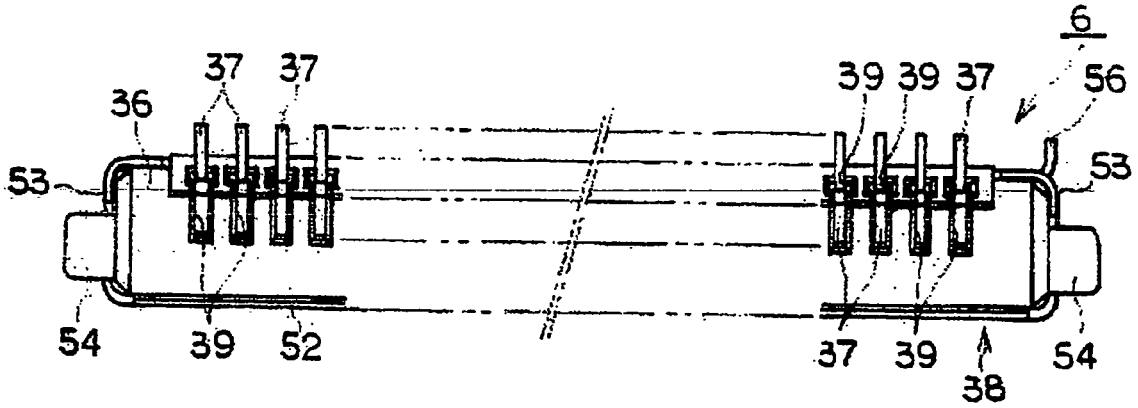
FIG. 16 is a bottom-view drawing of the socket of FIG. 1.
Figure 17:
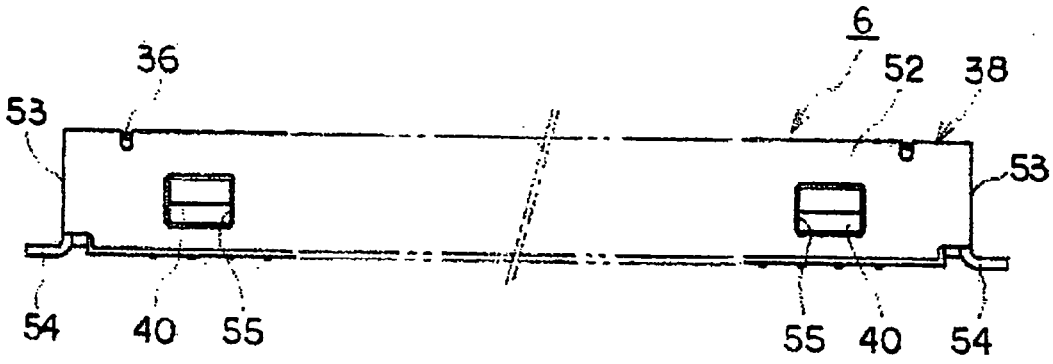
FIG. 17 is a rear-view drawing of the socket of FIG. 1.
Figure 18:
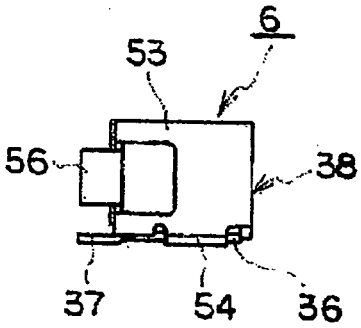
FIG. 18 is a side-view drawing of the socket of FIG. 1.
Figure 19:
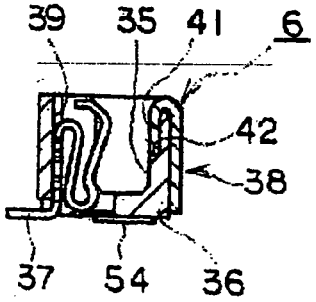
FIG. 19 is a cross-section drawing of the socket of FIG. 1.

As shown in FIG. 12, once transported to the predetermined position, the plugs 5 supported by the plug attachment tool member 24 are mounted on the secondary substrate 3. Reflowing or the like is performed to connect the plug contact terminal pieces 17 and the securing piece 22 of the plug shield member 9 to the terminal pattern and the securing pattern formed on the secondary substrate 3. The electronic components 1 can also be surface mounted on the secondary substrate 3 at the same time.

By removing the plug attachment tool member 24 from the plugs 5, a secondary substrate assembly A is completed in which the plugs 5 are aligned with the shield perimeter wall, i.e., are surrounding the electronic components 1 on the secondary substrate 3.

As shown in FIG. 14 through FIG. 19, the socket 6 is equipped with: a socket housing 36 including a plug insertion hole 35 into which the plug 5 is inserted. Multiple socket contacts 37 can be supported by the socket housing 36 and project into the plug insertion hole 35. A socket shield member 38 can fit to the outer side surface of the socket housing 36.

The socket housing 36 can be formed from synthetic resin in the shape of a wide box with the plug insertion hole 35 opening up to the upper surface.

The socket housing 36 is formed with multiple contact attachment holes 39 that pass all the way through vertically and that communicate with the plug insertion hole 35. The contact attachment holes 39 are disposed parallel to each other at a predetermined interval. The socket contacts 37 are inserted into the contact attachment holes 39 and are supported by them.

Engagement projections 40 are formed integrally with the outer side surfaces of the socket housing 36 to secure the socket shield member 38. A bent connection piece 41 formed at the upper edge of the socket shield member 38 fits into an engagement cavity 42 formed at the edge of the opening of the plug insertion hole 35.

Figure 20A:
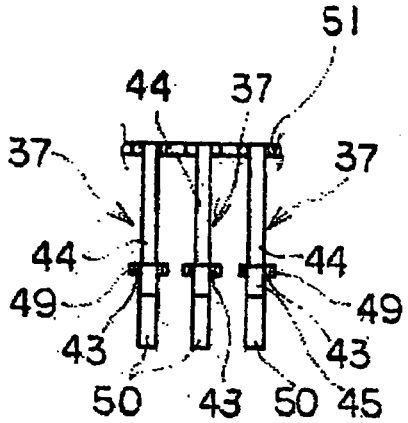
FIG. 20(*a*) is a plan drawing showing a socket contact supported by a carrier plate of the present invention.
Figure 20B:
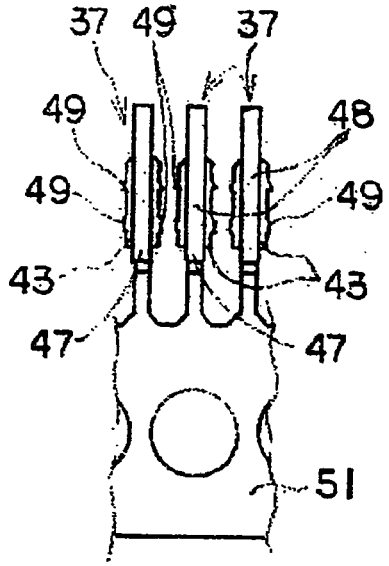
Figure 20C:
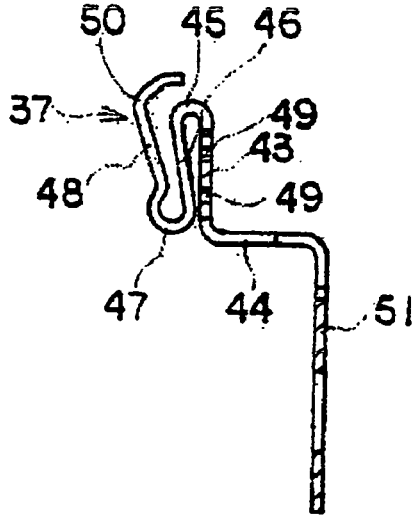

As shown in FIG. 20, the socket contact 37 includes an attachment piece 43 supported by the socket housing 36, a bent terminal 44 continuous with one end of the attachment piece 43, and a first bend 45 bent in a "U" shape from the other end of the attachment piece 43. A connecting piece 46 can be continuous with the other end of the first bend 45. A second bend 47 can be bent arcuate from the other end of the connecting piece 46 and an elastic contact piece 48 can be continuous with the second bend 47 and extends diagonally upward. The socket contact 37 is formed by punching a conductive plate material such as copper alloy into a predetermined shape and bending it.

The attachment piece 43 is formed as a flat plate having a width roughly identical to that of the contact attachment hole 39. Engagement projections 49 are formed integrally with the side edges of the attachment piece 43.

The first bend 45, the connecting piece 46, and the second bend 47 are all formed with widths narrower than that of the attachment piece 43.

The elastic contact piece 48 is bent diagonally upward from the end of the second bend 47, and the tip is bent at an angle to form a contact 50.

The terminal piece 44 is bent perpendicular so that it points inside the shield perimeter wall from one end of the attachment piece 43.

The end of the terminal 44 opposite from the attachment piece 43 is connected integrally with a carrier plate 51. Multiple socket contacts 37 are supported by the carrier plate parallel to each other and at a predetermined pitch, i.e., at the pitch used to attach the socket contacts 37 to the socket housing 36.

The terminal 44 and the carrier plate 51 are formed with notches at the side edge of the connecting point so that once the socket contacts 37 are attached to the socket housing 36, the terminal 44 and the carrier plate 51 can be easily separated.

The socket shield member 38 is equipped with a flat shield plate 52, a bent connection piece 41 bent inward from the upper edge of the shield plate 52, grips 53, 53 formed integrally with the side edges of the shield plate 52, and securing pieces 54 projected outward from the lower edges of the grips 53. The socket shield member 38 can be formed by bending a conductive metal plate.

The shield plate 52 is formed with engagement holes 55 at either end to engage with the engagement projections 40 of the socket housing 36. Bent connection pieces 41 are formed integrally with the holes and are bent inward from the upper edges thereof.

The grips 53 can be formed by bending the side edges of the shield plate 52 in a square "C" shape, serve to grip the sides of the socket housing 36.

A shield connection piece 56 projecting inwardly from the shield perimeter wall can be formed by forming a square "C"-shaped cut in one of the grips 53 and bending it at the base end of the cut.

The socket attachment tool member 57 is used to secure the sockets 6 to the substrate 2 so that the electronic components 1 are surrounded.

Figure 21A:
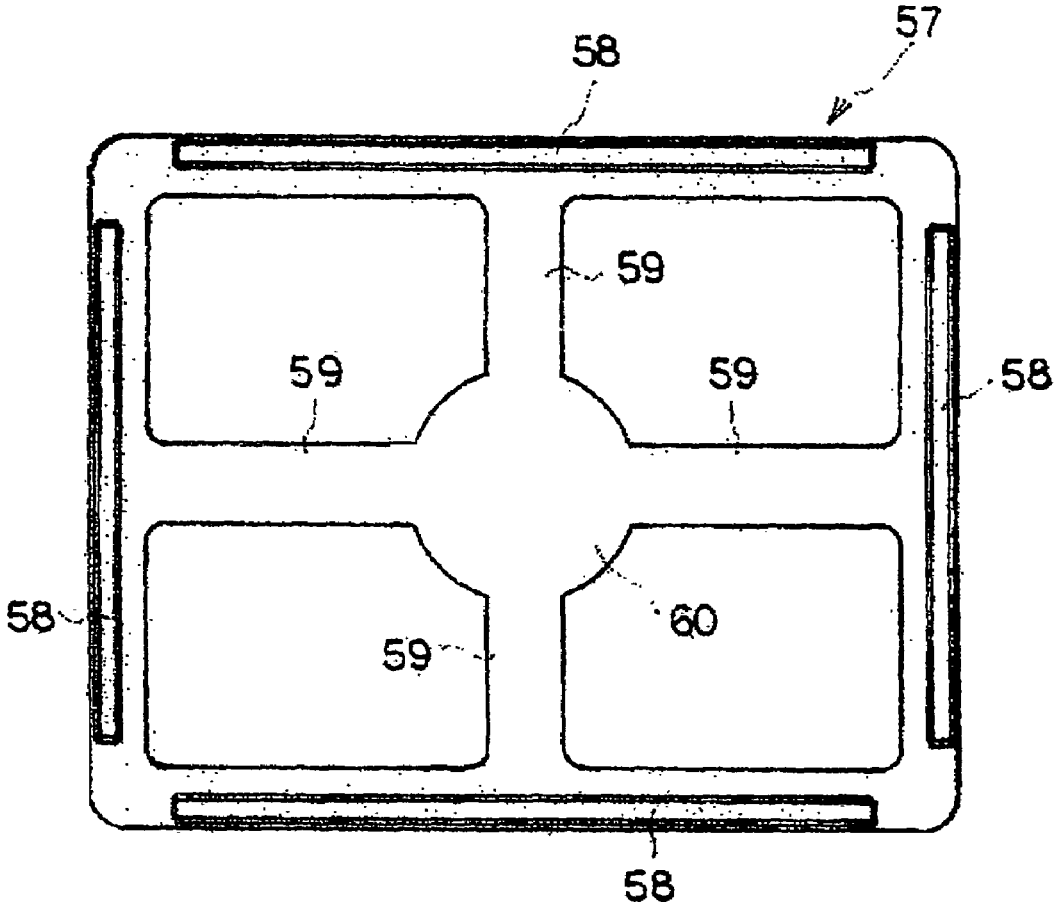
FIG. 21(*a*) is a plan drawing of a socket attachment tool member embodiment of the present invention.
Figure 21B:
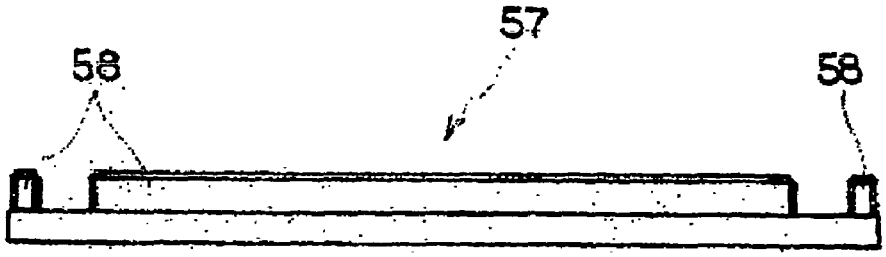

As shown in FIG. 21, the socket attachment tool member 57 is formed as a frame equipped with supports 58 projecting from the four edges of one side. A circular suction section 60 is supported at the center of the frame by supports 59. This suction section 60 can be suctioned and transported by a transporting device of the production device.

The supports 58 are arranged in the shape of the shield perimeter wall, and are set up so they can be inserted and fitted into the plug insertion holes 35. In other words, with this socket attachment tool member 57, the sockets 6 are supported by the supports 58 so that they are aligned with the shape of the shield perimeter wall.

To mount the socket onto the main substrate 2 using the socket attachment tool member 57, the socket attachment tool member is first used to support the sockets 6. Then, the suction section 60 is suctioned by the automated transporting device and transported to a predetermined position over the substrate, i.e., a position where the sockets 6 would surround the electronic components 1 mounted on the main substrate 2.

Figure 22:
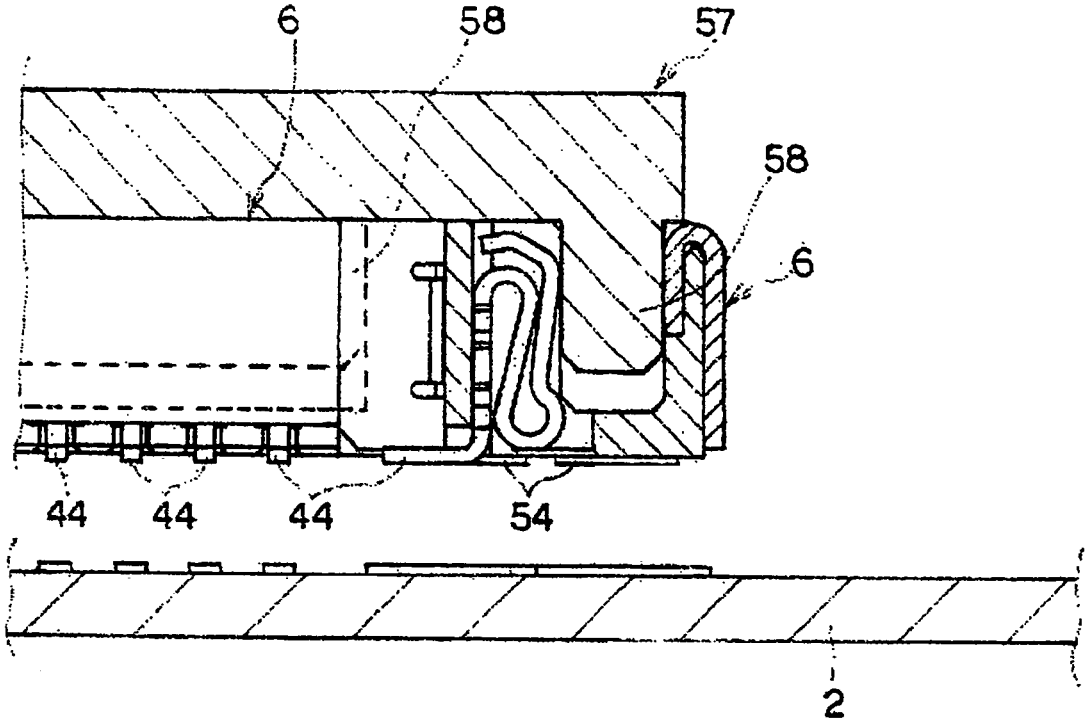
FIG. 22 is a cross-section detail drawing showing a socket attachment step of the present invention.

As shown in FIG. 22, once sockets 6 have been transported to the predetermined position, the sockets 6 are mounted on the main substrate 2 while still being supported by the socket attachment tool member 57. From this state, reflowing or the like is used to secure the socket contact terminal pieces 44 and the securing pieces 54 of the socket shield member 38 to the terminal pattern and securing pattern formed on the main substrate 2. It would also be possible to have the electronic components 1 surface mounted on the main substrate 2 at the same time.

Figure 23:
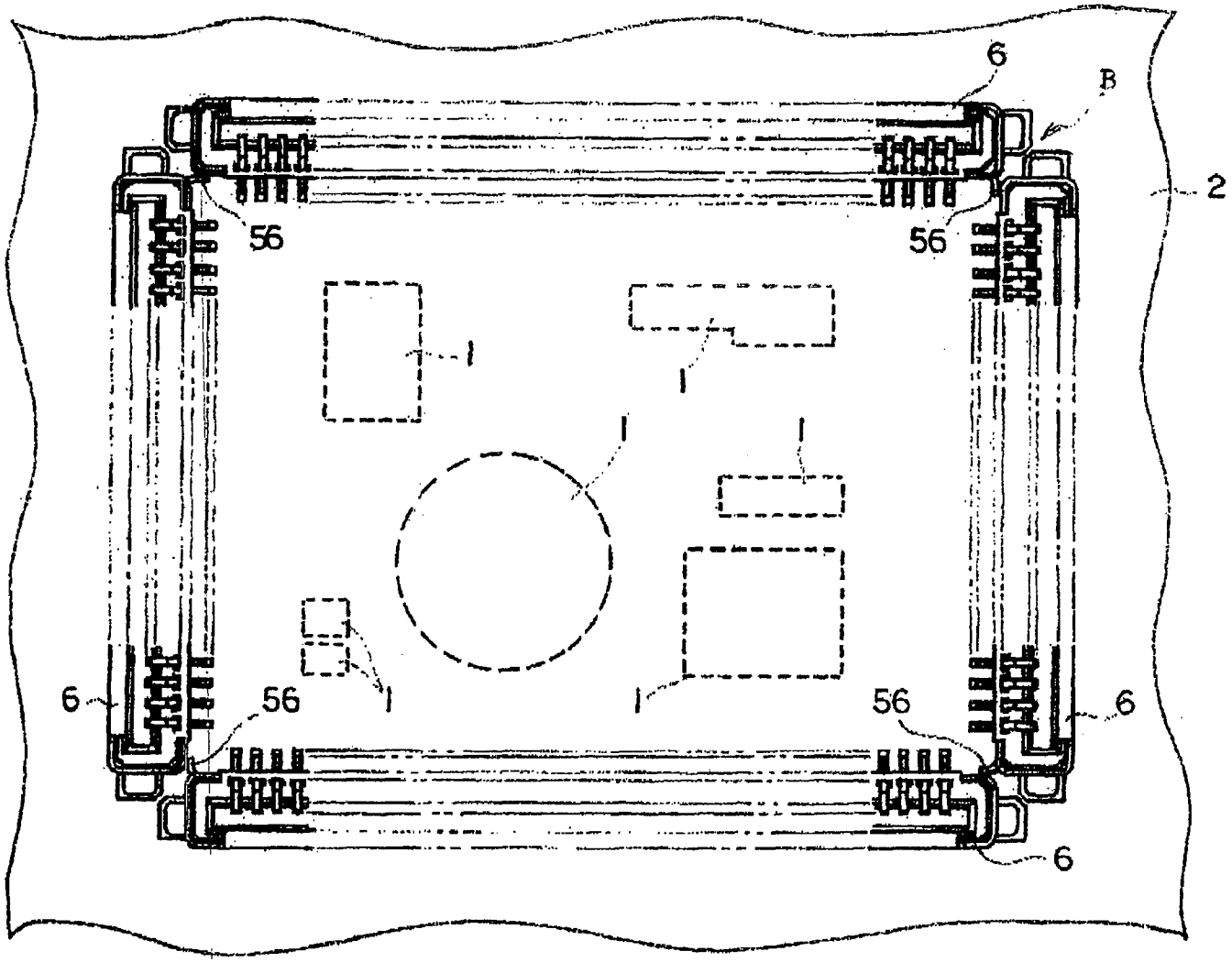
FIG. 23 is a plan drawing showing a main substrate assembly of FIG. 22.

Finally, the socket attachment tool member 57 is removed from the sockets 6. As shown in FIG. 23, this completes a main substrate assembly B, in which the sockets 6 are mounted in alignment with the shield perimeter wall, i.e., so that they surround the electronic components 1 on the main substrate 2.

In the main substrate assembly B, the socket shield member 38 includes shield connection pieces 56 so that when the sockets 6 are attached, the shield connection pieces 56 come into contact with the socket shield members 38 of the sockets 6 adjacent along the perimeter. Thus, the gaps between sockets adjacent to each other along the perimeter are shielded, resulting in an improved shield.

In this type of shield structure, the main substrate assembly B is connected to the secondary substrate assembly A, thus connecting the plugs 5 to the sockets 5 and providing electrical connection between the main substrate 2 and the secondary substrate 3. As a result, the electronic components 1 mounted on the main and secondary substrates 2, 3 can form a single electronic circuit.

Also, by having the electronic circuit surrounded by a shield perimeter wall, i.e., the main substrate 2, the secondary substrate 3, and the multiple shielded substrate connectors 4, the electronic circuit formed from the electronic components 1 within the wall can be shielded.

Furthermore, since the socket shield member 38 includes shield connection pieces 56, the shield connection pieces 56 can come into contact with socket shield members 38 adjacent to each other along the perimeter, thus shielding the spaces between sockets adjacent to each other along the perimeter. In other words, the shield connection piece 56 connects the space between shielded substrate connectors 4 that are adjacent to each other along the perimeter so that a tight shield is provided.

In the embodiment described above, the plug is mounted on the secondary substrate 3 and the socket is mounted on the main substrate 2, but the plug 5 and the socket 6 can be mounted on either the main or secondary substrate 2, 3.

Also, in the embodiment described above, the shielded substrate connectors 4 are arranged in a four-sided shape, but the electronic components can be surrounded using other polygonal shapes.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A shield structure shielding electrical components having an electronic circuit comprising:

a main substrate for mounting the electronic components;

a secondary substrate separated by a space from said main substrate, the electronic components forming said electronic circuit being mounted on a surface of said secondary substrate that faces a mounting surface of said main substrate; and a mechanically continuous shield perimeter wall, excluding the main substrate and secondary substrate, including a plurality of shielded substrate connectors connecting said main substrate and said secondary substrate forming an electrical shield around said electronic circuit; and said plurality of shielded substrate connectors comprising:

a plug mounted on one of said main and secondary substrate; and a socket mounted on the other of said main and secondary substrate and detachably connected to said plug.

2. The shield structure as described in claim 1 wherein said plug includes a plurality of plug contacts and a plug housing and said socket includes a plurality of socket contacts and a socket housing, said plug contacts and said socket contacts include:

an attachment piece supported by said housing;

a terminal continuous with one end of said attachment piece and pointing inward from said shield perimeter wall; and the shield structure further comprising a carrier integrally connected to a plurality of said terminals separated by spaces.

3. The shield structure as described in claim 1 wherein said plug comprises:

a synthetic resin plug housing;

a plurality of plug contacts including plug elastic contact pieces exposed on a side surface of said plug housing; and a plug shield member having a conductive metal member covering a second side surface opposite from said side surface from which said plug elastic contact pieces are exposed; and wherein said socket comprises:

a socket housing having a plug insertion hole for receiving said plug;

a plurality of socket contacts including a socket elastic contact piece projecting into said plug insertion hole; and a socket shield member having a conductive metal member covering a side surface of said socket housing; and said plug elastic contact piece contacts said socket elastic contact piece, and said plug shield member contacts said socket shield member.

4. The shield structure as described in claim 3 wherein said plug includes a plurality of plug contacts and a plug housing and said socket includes a plurality of socket contacts and a socket housing, said plug contacts and said socket contacts include:

an attachment piece supported by said housing;

a terminal continuous with one end of said attachment piece and pointing inward from said shield perimeter wall; and the shield structure further comprising a carrier integrally connected to a plurality of said terminals separated by spaces.

5. The shield structure as described in claim 1 wherein said shielded substrate connector further comprises a shield connection piece, including a conductive material, connecting said shielded substrate connectors that are adjacent to each other along said perimeter wall.

6. The shield structure as described in claim 5 wherein said plug comprises:

a synthetic resin plug housing;

a plurality of plug contacts including plug elastic contact pieces exposed on a side surface of said plug housing; and a plug shield member having a conductive metal member covering a second side surface opposite from said side surface from which said plug elastic contact pieces are exposed; and wherein said socket comprises:

a socket housing having a plug insertion hole for receiving said plug;

a plurality of socket contacts including a socket elastic contact piece projecting into said plug insertion hole; and a socket shield member having a conductive metal member covering a side surface of said socket housing; and said plug elastic contact piece contacting said socket elastic contact piece, and said plug shield member contacting said socket shield member.

7. The shield structure as described in claim 5 wherein said plug includes a plurality of plug contacts and a plug housing and said socket includes a plurality of socket contacts and a socket housing, said plug contacts and said socket contacts include:

an attachment piece supported by said housing;

a terminal continuous with one end of said attachment piece and pointing inward from said shield perimeter wall; and the shield structure further comprising a carrier integrally connected to a plurality of said terminals separated by spaces.

8. A shield structure shielding electrical components having an electronic circuit comprising:

a main substrate for mounting the electronic components;

a secondary substrate separated by a space from said main substrate, the electronic components forming said electronic circuit being mounted on a surface of said secondary substrate that faces a mounting surface of said main substrate; and a shield perimeter wall, that excludes the main substrate and the secondary substrate, including a plurality of shielded substrate connectors connecting said main substrate and said secondary substrate, said plurality of shielded substrate connectors being disposed so as to surround said electronic circuit, each of said plurality of shielded substrate connectors including:

a plug mounted on one of said main and secondary substrate; and a socket mounted on the other of said main and secondary substrate and detachably connected to said plug; and said shield perimeter wall further including a plurality of shield connection pieces, each including a conductive material mechanically inter-connecting adjacent said shielded substrate connectors, thereby electrically shielding gaps between said adjacent shielded substrate connectors.

9. A shield structure shielding electrical components having an electronic circuit comprising:

a main substrate for mounting the electronic components;

a secondary substrate separated by a space from said main substrate, the electronic components forming said electronic circuit being mounted on a surface of said secondary substrate that faces a mounting surface of said main substrate; and a shield perimeter wall including a plurality of shielded substrate connectors connecting said main substrate and said secondary substrate, said plurality of shielded substrate connectors being disposed so as to surround said electronic circuit and comprising:

a plug mounted on one of said primary and secondary substrate; and a socket mounted on the other substrate and detachably connected to said plug, wherein said plug includes a plurality of plug contacts and a plug housing and said socket includes a plurality of socket contacts and a socket housing, said plug contacts and said socket contacts include:

an attachment piece supported by said housing;

a terminal continuous with one end of said attachment piece and pointing inward from said shield perimeter wall; and the shield structure further comprising a carrier integrally connected to a plurality of said terminals separated by spaces.

* * * * *